US006360680B1

(12) United States Patent
Breen et al.

(10) Patent No.: US 6,360,680 B1
(45) Date of Patent: Mar. 26, 2002

(54) METHOD OF OPERATING A FURNACE BASED UPON ELECTROSTATIC PRECIPITATOR OPERATION

(75) Inventors: Bernard P. Breen, Pittsburgh, PA (US); James E. Gabrielson, Hanover, MN (US); Dennis Tobias, Pittsburgh, PA (US)

(73) Assignee: ESA Environmental Solutions, Inc., Pittsburgh, PA (US)

( * ) Notice: Subject to any disclaimer, the term of this patent is extended or adjusted under 35 U.S.C. 154(b) by 0 days.

(21) Appl. No.: 09/793,664

(22) Filed: Feb. 26, 2001

(51) Int. Cl.[7] ..... F23J 15/02; F23N 5/00

(52) U.S. Cl. ..... 110/345; 110/347; 110/342; 110/185; 110/187; 110/216; 110/101 C; 110/101 CF

(58) Field of Search ..... 110/185, 186, 110/187, 191, 216, 217, 342, 345, 347, 101 C, 101 CF, 165 R, 165 A; 431/12

(56) References Cited

U.S. PATENT DOCUMENTS 4,352,747 A * 10/1982 Every et al. ..... 252/500
4,602,573 A * 7/1986 Tanca ..... 110/342
4,770,674 A * 9/1988 Tellini et al. ..... 55/5
4,844,723 A * 7/1989 Tellini et al. ..... 55/106
4,846,081 A * 7/1989 Homer et al. ..... 110/186
4,893,315 A * 1/1990 Homer et al. ..... 374/37
5,032,154 A * 7/1991 Wright ..... 55/106
5,229,077 A * 7/1993 Bell et al. ..... 422/168
5,311,829 A * 5/1994 Clark et al. ..... 110/345
5,582,802 A * 12/1996 Spokoyny et al. ..... 422/173
5,597,403 A * 1/1997 Hankins ..... 96/23
5,678,493 A * 10/1997 Kelley et al. ..... 110/185

OTHER PUBLICATIONS

Printout from Energy Systems website (12 pages), dated Feb. 11, 2000.

* cited by examiner

*Primary Examiner*—Denise L. Esquivel
*Assistant Examiner*—K. B. Rinehart
(74) *Attorney, Agent, or Firm*—Buchanan Ingersoll, P.C.

(57) ABSTRACT

A method is provided for controlling the operation of a furnace. A furnace generally includes a boiler having a combustion zone, a plurality of burners burning a mixture of fuel and air in the combustion zone producing a gaseous by-product, and an electrostatic precipitator in fluid communication with the boiler removing particulates from the gaseous by-products. The method includes the steps of monitoring operating conditions of the electrostatic precipitator on a section-by-section basis, and controlling a select one or more of the burners based upon the section-by-section monitored operating conditions.

26 Claims, 4 Drawing Sheets

METHOD OF OPERATING A FURNACE BASED UPON ELECTROSTATIC PRECIPITATOR OPERATION

FIELD OF THE INVENTION

The present invention is directed toward furnace control and, more particularly, toward controlling the operation of a furnace and the combustion conditions within the furnace based upon electrostatic precipitator operating conditions.

BACKGROUND OF THE INVENTION

Controlling furnace operation for optimum combustion and performance is of great importance in the industry. Ever since furnaces were first operated, optimizing combustion and performance have been desired goals, and various methods have been developed over the years in an attempt to achieve these goals. For example, as late as the middle of the twentieth century, shipboard operators utilized a method known as efficiency haze in an attempt to optimize boiler combustion. The efficiency haze method required a shipboard, or boiler, operator to visibly monitor the cloud of smoke emanating from the stack of the furnace. For boilers fired by oil, the boiler operator would reduce the excess air into the boiler until there was a faint but visible plume of smoke emanating from the stack. This faint but visible plume of smoke indicated to the boiler operator that not too much excess air was being used, stack heat losses were at a minimum, and most of the carbon present in the oil was being burnt.

Similarly, boilers fired by coal were also controlled by monitoring the visible plume of smoke emanating from the stack. However, coal-fired boiler operators would watch for a darkening of the visible plume of smoke. The darkening of the visible plume of smoke was caused by flyash from the coal and indicated to the boiler operator that unburned coal was being emitted, i.e., that combustion was not complete. The boiler operator would then modify the air flow to the boiler in order to optimize combustion of the coal. Other analysis techniques, such as the Orsat analysis and various other types of instrument analyses, were also developed to determine gas compositions and improve the operation of the furnace. However, these prior art analyses techniques were mostly performed in the stack, and adjustments were made only to the total airflow into the boiler.

Today, large utility boilers often have multiple oxygen sensors in the flue gas stream, typically located at the outlet of the economizer. The sensor outputs are made continuously available in the furnace control room, and airflow to the boiler may be modified based on the sensor outputs. Alarms may be provided for low oxygen even at only one sensor. The sensors provide signals representative of the oxygen concentration in various parts of the furnace, thus permitting adjustments to be made to increase or decrease the excess air on one or more sides, or one or more corners, of the furnace. However, oxygen concentration in the flue gas, which is sensed by the sensors, is not the total answer to the problem of optimizing furnace operation. For example, the oxygen concentration sensed by the sensors may be caused by an infusion of air into the boiler through bad seals and/or casing holes. Since this infused air usually occurs after combustion is quenched by temperature loss, it is not relevant to combustion conditions and, as such, may result in adjustments being made which actually degrade furnace operation. In other cases, coal feed pipes and coal particle size may become unbalanced within certain burners or regions of the furnace such that incomplete combustion problems do not appear as oxygen deficiencies, but rather as unburnt carbon problems.

Combustion monitors have also been developed in an effort to improve furnace combustion control. Combustion monitors typically take the form of a carbon monoxide (CO) monitor. Carbon monoxide is the most common gaseous by-product of incomplete combustion. The presence of CO often indicates that there is insufficient air for combustion, but CO may also be present in the flue gases due to other reasons, such as, but not limited to, poor air/fuel mixing, poor particle size grinding (assuming coal is used as the fuel), delayed ignition, and rapid cooling. While multiple CO monitors could be installed in various sections of the furnace to monitor and control combustion, such an array of CO monitors is expensive to install and operate. Further, gaseous CO monitors cannot determine if combustion of the solid or liquid components of the fuel is complete.

Other methods of determining the completeness of fuel combustion have been developed, again in an effort to optimize furnace operation. When coal is used as the fuel to be burned, one such method that has been developed is to measure the combustibles in the flyash. One prior method of measuring combustibles in the flyash is to observe the opacity and color of the smoke emanating from the stack (efficiency haze). However, observing smoke opacity and color sometimes only indicates how well the particulate collection equipment (electrostatic precipitator) is working, and at best only indicates total furnace operation rather than indicating how well various sections of the furnace are performing. It has also been found that substituting an automatic and continuous opacity monitor for an operator's visual observations does not change matters much. While some work has been done on developing continuous and instantaneous flyash carbon instruments, they have not been very successful since standard methods of flyash collection and carbon or loss on ignition analyses are too slow for proper furnace control. Other methods that have been developed include optical absorption or emission characterization of the flyash particle clouds in-situ, but these generally still have to be correlated back to an implied carbon content of the flyash entering the electrostatic precipitator.

The ultimate $NO_x$ emissions will increase if the individual burner air/fuel ratio is increased. Corrosion of some of the boiler tubes may increase if the air/fuel ratio of particular burners is reduced too far. While operators usually attempt to maintain the air/fuel ratio the same for all burners by controlling all coal feeders at he same rate and all secondary air registers at the same location or by following the feeder speeds with secondary air adjustments to individual burners this procedure often does not result in uniform air/fuel ratios between the various burners. Even measurements of the secondary air flow and the primary air flow will, at times, result in errors in each as large as plus-or-minus 8%, and when these errors are coupled with coal feeder errors and different coal loading in the primary air to the different burners supplied by the same pulverizers, the air/fuel ratios for different burners can differ by 25% or more.

It is desirable to control the air/fuel ratios the same for all burners to allow minimum excess air operation without excessive tube corrosion, CO emissions, or carbon in the flyash. Minimum excess air operation is necessary to increase unit efficiency, reduce $NO_x$ emissions, and often simply to reduce the total air and flue gas flows which allows for higher capacity when a unit is air fan limited.

The present invention is directed toward overcoming one or more of the above-mentioned problems.

SUMMARY OF THE INVENTION

A method is provided for controlling the operation of a furnace. A furnace generally includes a boiler having a combustion zone, a plurality of burners burning a mixture of fuel and air in the combustion zone producing a gaseous by-product, and an electrostatic precipitator in fluid communication with the boiler removing particulates from the gaseous by-product. The method includes the steps of monitoring operating conditions of the electrostatic precipitator on a section-by-section basis, and controlling a select one or ones of the plurality of burners based upon the section-by-section monitored operating conditions.

The various operating conditions of the electrostatic precipitator which may be monitored on a section-by-section basis include, but are not limited to, spark rate, voltage recovery rate, power usage, rapping frequency, and the opacity of the gaseous by-product upon exit from the electrostatic precipitator.

In one form, each of the plurality of burners includes a primary air and fuel line and a secondary air duct. The primary air and fuel line supplies the mixture of fuel and air to be burned in a pre-select fuel/air ratio at a pre-select primary flow rate. The secondary air duct supplies a secondary flow of air to assist in the burning process. In this form, the controlling step includes modifying at least one of the pre-select fuel/air ratio, the pre-select primary flow rate and the secondary flow of air for a select one or ones of the plurality of burners based upon the section-by-section monitored operating conditions of the electrostatic precipitator.

The monitored sections of the electrostatic precipitator may be associated with the plurality of burners on a one-to-one basis, or may be associated with plural burners burning their respective fuel/air mixtures in particular regions of the boiler combustion zone.

In a preferred form, the fuel to be burned includes coal of various types, with the particulates in the gaseous by-product including flyash.

In another form, the fuel burned includes a fuel which produces solid particles during combustion and the solid particles are discharged in the gaseous combustion products as flyash.

In another form, the furnace is equipped with cyclones rather than burners. Such cyclones have primary air of an unusual type and secondary air, but the coal is not pulverized and the primary air does not carry the coal into the cyclone. Either the fuel flow or the secondary air flow to individual cyclones can be changed to alter the air/fuel ratio of the individual cyclones. There may be as few as one-tenth as many cyclones in a boiler as there are burners in a pulverized coal fired furnace of the same capacity.

In another form, the select one or ones of the plurality of burners are controlled to optimize furnace operation, reduce $NO_x$ emissions, reduce CO emissions, and/or reduce particulates present in the gaseous by-product.

In yet another form, the monitored sections of the electrostatic precipitator are assigned to the plurality of burners based on select criteria, with control of the plurality of burners based upon the monitored operating conditions of its assigned section of the electrostatic precipitator. Each section of the electrostatic precipitator may be assigned to a different one of the plurality of burners, or may be assigned to plural burners burning their respective fuel/air mixtures in particular regions of the boiler combustion zone. In this form, the adaptive process control software creates a dynamic model, which is then used to decide if there are statistically significant interactions between section-by-section monitored ESP conditions and specific burners.

In still another form, a dynamic process model is developed from the section-by-section monitored operating conditions of the electrostatic precipitator, and control of the plurality of burners is based upon variations in the dynamic process model.

Other aspects, objects and advantages of the present invention can be obtained from a study of the application, the drawings, and the appended claims.

DETAILED DESCRIPTION OF THE INVENTION

Figure 1:
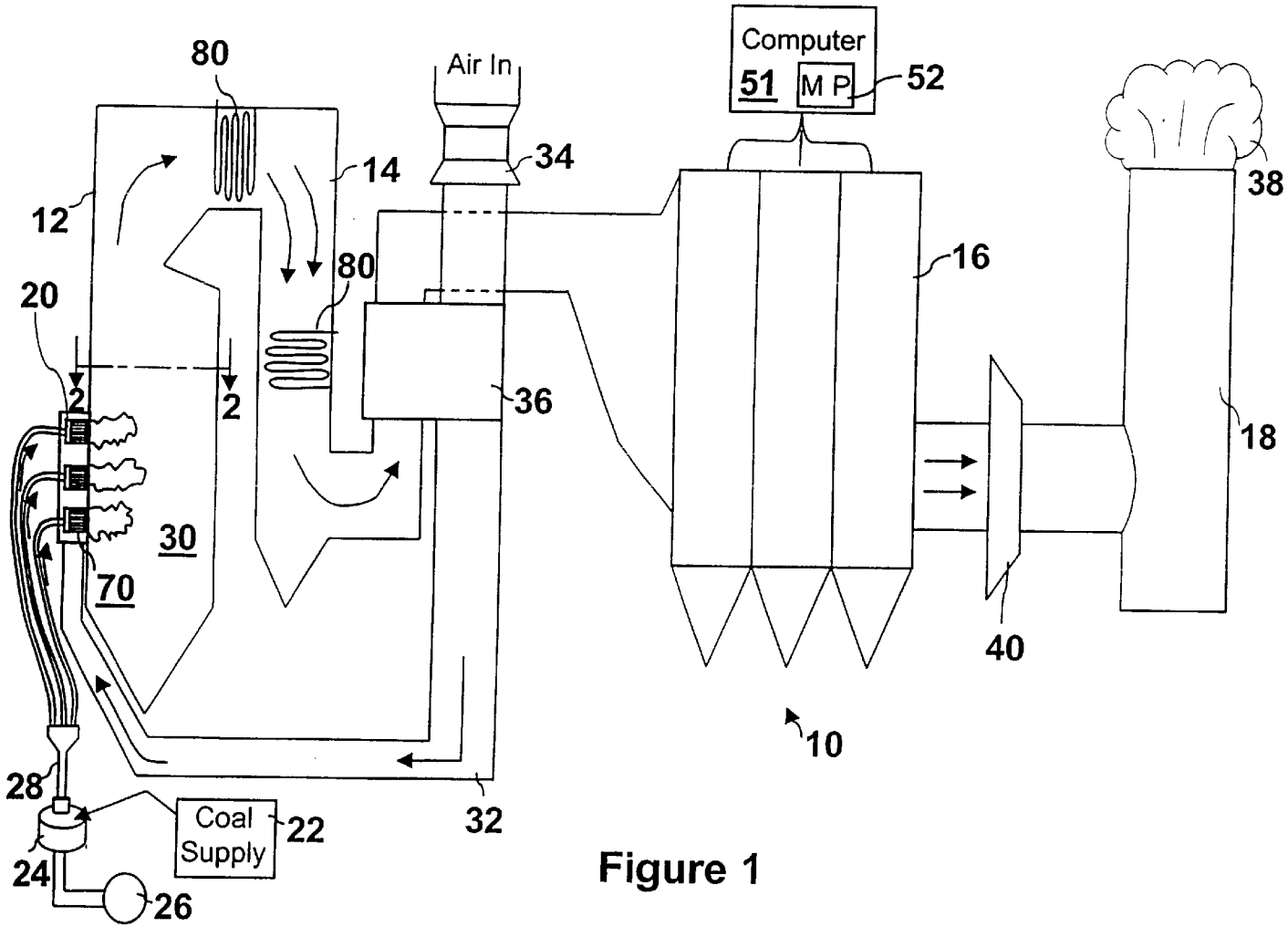
FIG. 1 is a diagram of a furnace utilizable in practicing the present inventive method.

Improving combustion control is a continuing concern in furnace operation. For improved combustion control, it is necessary to not only know the overall conditions of combustion, but also local information associated with each of the burners. This local information preferably includes burner-by-burner fuel/air ratios and burner performance. This information is important since the ultimate burn out of the fuel is somewhat dependent upon the individual burner air/fuel ratio. While these burners may have the correct fuel/air ratio being supplied thereto, due to their defects combustion will still be incomplete. While some of these problems may be corrected by mixing between burners if there is sufficient excess air in the boiler, there is no guarantee that such will be the case.

Further, most utility boilers and other large furnaces today are subject to $NO_x$ emission limitations imposed by various regulatory authorities. Since $NO_x$ emissions increase with increasing excess air proximate the burner, it is critical to operate each burner in a furnace with the lowest possible excess air while still achieving complete combustion. However, operating a burner with insufficient air leads to carbon emissions, CO emissions, efficiency loss, and often to serious waterwall tube corrosion. Therefore, it is necessary to operate each burner at a precise, correct fuel/air ratio (which results in minimum unburnt carbon reporting to the ESP, while at the same time operating at minimum oxygen, and thus minimum $NO_x$).

Additionally, it is important to control the operation of electrostatic precipitators included within the furnace in order to control particulate emissions in the gaseous by-product. In addition to the general requirements that electrostatic precipitators reduce particulate emissions as much as possible, and that the emissions meet various regulations imposed by various regulatory authorities, new concerns and regulations have surfaced regarding the emission of very fine particulates. These very fine particulates, as small as 1 to 10 micrometers in diameter, are viewed as a health hazard and are becoming subject to more and more environmental regulations. By weight, these fine particulates make up only a small portion of the total particulates discharged from a furnace. However, they are difficult to remove from the flue gas and can only be removed when the electrostatic precipitator is operating at peak performance. Consequently, a further requirement in furnace operation is to operate the electrostatic precipitator as efficiently as possible.

Carbon is conductive, and when it is collected on the flyash layer, which is on the collecting electrode of the furnace, the charge on the carbon particle rapidly flows off of the carbon particle and toward the electrode. Then the carbon particle is not held to the collected flyash and may fall off and return to the gas stream. In this manner, carbon particles can be collected many times and even particles much larger than 10 micrometers can flow to the final field of the ESP or out of the stack. When these large carbon particles become concentrated relative to the flyash particles that are being removed, a number of them may collect in close proximately to each other in the flyash layer. The unburnt carbon the n forms a partial conductive path (part of the way) from the outside of the collected flyash to the collecting electrode. The collected layer has an almost constant voltage across it from the gas to the collecting plate. Through the conductive path there is almost no voltage drop and the voltage gradient in the remainder of the path increases. When the voltage gradient exceeds the dielectric strength of the electrically resistant flyash, about 20 KV/cm, there is an arc and an upset of the collected flyash layer causing re-entrainment. The section of the ESP where this arc happens shuts down and is not collecting flyash. While the controllers bring the voltage up very rapidly and the section returns to service, when this happens too often the operation of the ESP suffers and the flyash emissions increase. The most efficient operation of the electrostatic precipitator occurs when the flyash is free of electrically disruptive unburned carbon particle inhomogeneities. The present inventive method has thus been developed in an effort to both optimize overall furnace operation and electrostatic precipitator performance.

A conventional furnace 10, illustrated in FIG. 1, generally includes a boiler 12, an economizer 14, an electrostatic precipitator (ESP) 16 and a stack 18. The boiler 12 includes a plurality of burners 20 typically located on the front and/or rear walls of the boiler 12. For convenience, only three burners 20 are shown in FIG. 1.

Operation of the furnace 10 requires a supply of fuel to be burned, such as a coal supply 22. The coal supply 22 supplies coal at a predetermined rate to a pulverizer 24, which grinds the coal to a small size sufficient for burning. The pulverizer 24 receives a primary flow of air from a primary air source 26. Only one pulverizer 24 is shown, but many are required for a large boiler, and each pulverizer 24 may supply coal to many burners 20. A stream of primary air and coal is carried out of the pulverizer 24 through line 28. The primary stream of air and coal in line 28 is fed to the burner 20, which burns the fuel/air mixture in a combustion zone 30 defined by the boiler 12.

To assist in the burning, the furnace 10 includes a secondary air duct 32 providing a secondary air flow to the burner 20. Usually about 20% of the air required for optimum burning conditions is supplied by the primary air source 26; the secondary air duct 32 is used to provide the remaining air. The secondary air duct 32 brings the excess air in from the outside via a fan 34, and the air is heated with an air preheater 36 prior to providing the air to the burner 20.

Figure 2:
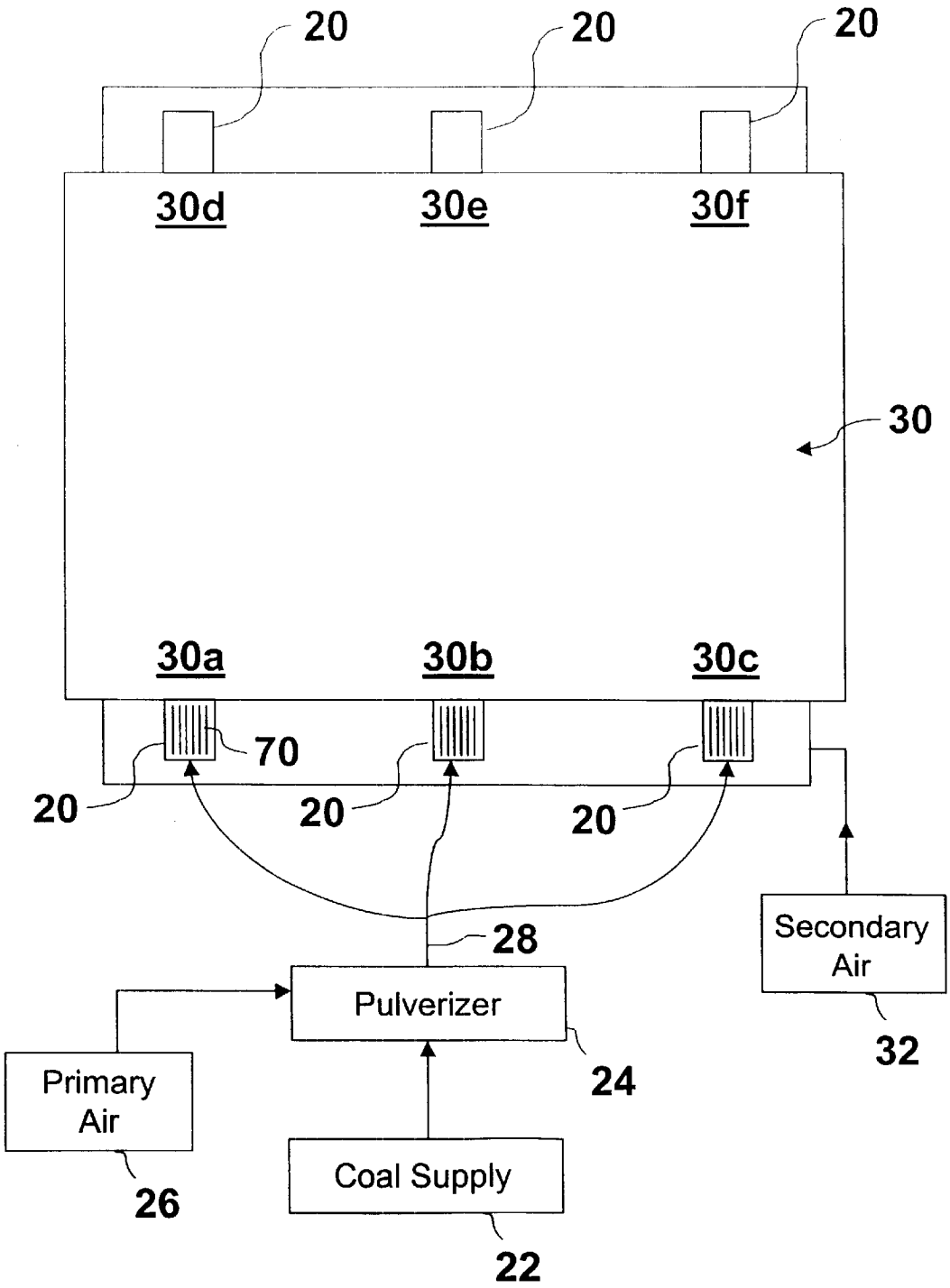
FIG. 2 is a sectional view of the furnace taken along the line 2—2 in FIG. 1.

While only three burners 20 are shown in FIG. 1, the furnace 10 typically has a plurality of burners 20 spaced about the boiler 12, as is shown in FIG. 2. While FIG. 2 shows three burners 20 on the front of the boiler 12 and three burners 20 on the rear of the boiler 12, it should be understood there are typically many more burners in a conventional furnace. Any number of burners 20 may be utilized without departing from the spirit and scope of the present invention. Although shown for only three burners 20 in FIG. 2, each of the burners 20 includes an associated coal supply 22, pulverizer 24, primary air source 26 and secondary air source 32 for supplying a fuel/air mixture to the respective burner 20. Several burners may share a secondary air windbox and each burner usually has an adjustable secondary air register 70 to control the air flow to it. Each of the burners 20 burns its respective fuel/air mixture in the combustion zone 30 of the boiler 12. The combustion zone 30 is divided into various regions, each associated with a different burner 20. As shown in FIG. 2, the combustion zone 30 is divided into regions 30*a*, 30*b*, 30*c*, 30*d*, 30*e*, and 30*f*. Each of the burners 20 burns its respective fuel/air mixture in a respective one of the burning regions 30*a–f*. While FIG. 2 depicts the burning region 30*a–f* and burners 20 in a one-to-one association, more than one burner 20 may be associated with a particular burning region.

Referring back to FIG. 1, as the plurality of burners 20 burn their respective fuel/air mixtures in the burning area 30, a gaseous by-product is produced. The gaseous by-product flows in the direction of the arrows out of the boiler 12, through the economizer 14, through the ESP 16 and into the stack 18 where it is exhausted to the atmosphere at 38. A fan 40 aids the flow of the gaseous by-product in this manner. Various processing and testing procedures are performed on the flue gas as it flows from the boiler 12 through the various furnace elements and is exhausted by the stack 18, however, these procedures and tests are conventional in the art and descriptions thereof are not necessitated. The flue gas is also used to heat steam and water in convective passes 80, as is known in the art.

While we have shown an opposed fired boiler 12 in FIGS. 1 and 2, the inventive method works as well on various types of boilers, including, but not limited to, single face fired boilers, tangentially fired boilers, and cyclone fired boilers. While the opposed fired, single face fired, and tangentially fired boilers typically utilized a pulverized fuel, the cyclone fired boilers typically do not.

Figure 3:
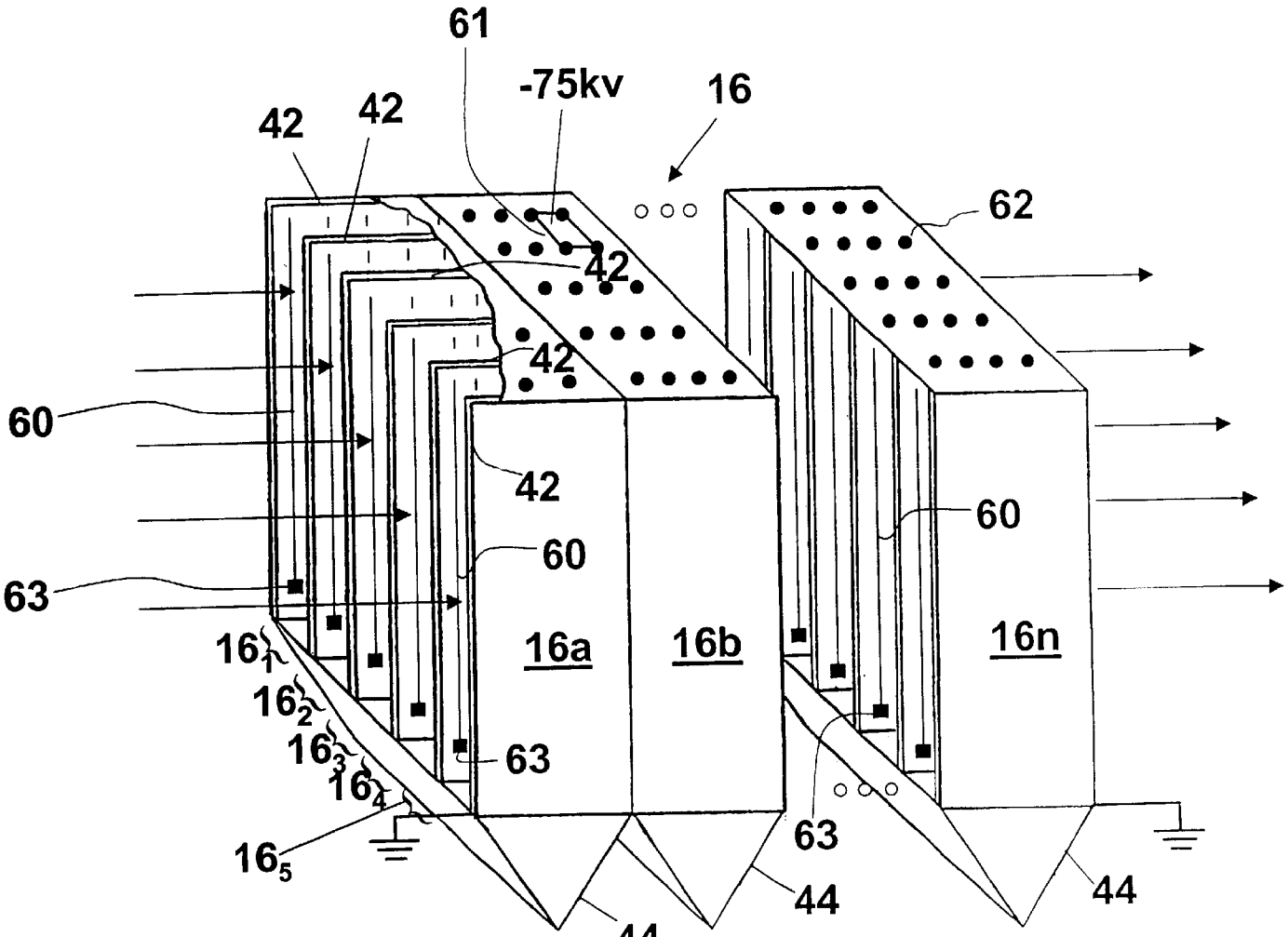
FIG. 3 is a perspective view of the electrostatic precipitator included in the furnace shown in FIG. 1.

The function of the ESP 16 is to remove particulates from the gaseous by-product and, more particularly, to remove flyash from the gaseous by-product, which normally is produced when coal is the fuel being burnt. As shown more specifically in FIG. 3, the ESP 16 includes a plurality of spaced apart plates 42 spaced such that the gaseous by-product flows between them in flow areas $\mathbf{16}_1$, $\mathbf{16}_2$, $\mathbf{16}_3$, . . . While six plates 42 are illustrated in FIG. 3, any number of plates 42 may be included in the ESP 16 without departing from the spirit or scope of the present invention. Typical ESPs utilize many more than six plates. The ESP 16 is also divided into a plurality of fields $\mathbf{16}_a$, $\mathbf{16}_b$, . . . , $\mathbf{16}_n$ displaced in the direction of the flow of the gaseous by-product. Each of the ESP 16 fields usually includes its own reservoir, or hopper, 44 for collecting the flyash removed from the flue gas by the ESP 16. The fields $\mathbf{16}_a$, $\mathbf{16}_b$, . . . , $\mathbf{16}_n$ are one behind the other in the ESP 16, and typically there are three to six fields in an ESP. The ESP 16 is also divided into cells, the division lines of which are 90 degrees to the field division lines and in the direction of gas flow. The intersection of cell boundaries and field boundaries defines a section. Each section usually has its own transformer-rectifier set and controller (not shown). The transformer-rectifier boosts the electrical potential from a few hundred volts to 25–75 kilovolts, and changes the power from AC to DC. It should be understood that the ESP 16 may be divided into any number of sections without departing from the spirit and scope of the present invention. Typical ESPs utilize many sections.

As shown in FIG. 3, a negative voltage, −75 kV, is applied to emitting electrodes 60 of the ESP 16, with the plates, or collecting electrodes, 42 of the ESP 16 connected to ground. A voltage is established between each of the emitting electrodes 60 and the plates 42 on either side of the emitting electrode 60. The emitting electrode 60 emits electrons which strike gas molecules and removes an electron to form a positive ion which migrates to the emitting electrode 60, or it remains with the gas molecule to form a negative ion which migrates toward the collecting electrode 42. A single electron emitted from the emitting, or negative electrode, 60 may result in the ionization of many gas molecules through the production of many electrons. Since this occurs near the negative electrode 60, the positive ions are immediately neutralized at the negative electrode 60, while the negative ions migrate toward the plate, or positive electrode, 42. Before the ions reach the collecting electrode 42, and even before they reach the collected flyash layer, they become attached to flyash particles. The particles are now negatively charged and they are attracted to the grounded, relatively positive collecting electrode 42. The particles build up as a cake on the collecting electrode 42 and are thereby removed from the flue gas stream. By dividing the ESP 16 into fields $\mathbf{16}_a$, $\mathbf{16}_b$, . . . , $\mathbf{16}_n$ and cells, ESP sections are developed. As will be described in more detail below, it has been found that by monitoring the operating parameters associated with the ESP sections, modifications can be made to operation of the burners 20 to achieve complete combustion and optimize furnace operation. We will usually monitor one rank of sections and by comparison determine which one may be receiving more carbon particles. The burners 20 associated with a given section will be adjusted until the problem is resolved. It may be that only one burner 20 will be the offender, and in that case a computer model will identify the offending burner 20 and correct it while keeping the other burners 20 producing gas for the particular section as they were or by returning them to their original settings.

The emitting electrode 60 is electrically insulated from every part of the ESP 16 except its transformer-rectifier set and the other emitting electrodes 60 serviced by the same transformer-rectifier set to which they are connected by conducting wires 61. The emitting electrodes 60 are hung from insulators 62. The emitting electrodes 60 are kept in place at the bottom by heavy weights 63, which may weigh 20 to 30 pounds. The weights 63 may have guides to keep them in place, but they are insulated from the guides. The emitting electrodes 60 are typically 0.1 inch diameter wires and extend from the top of the ESP 16 to near the bottom. The weights 63 are necessary to prevent the wires 60 from swinging in the wind caused by the gas flow and striking the collecting electrodes 42 causing an arc and shutting down the section. This size and wire configuration may change in practice, but the essence is an emitting electrode insulated from a collecting plate.

Figure 4:
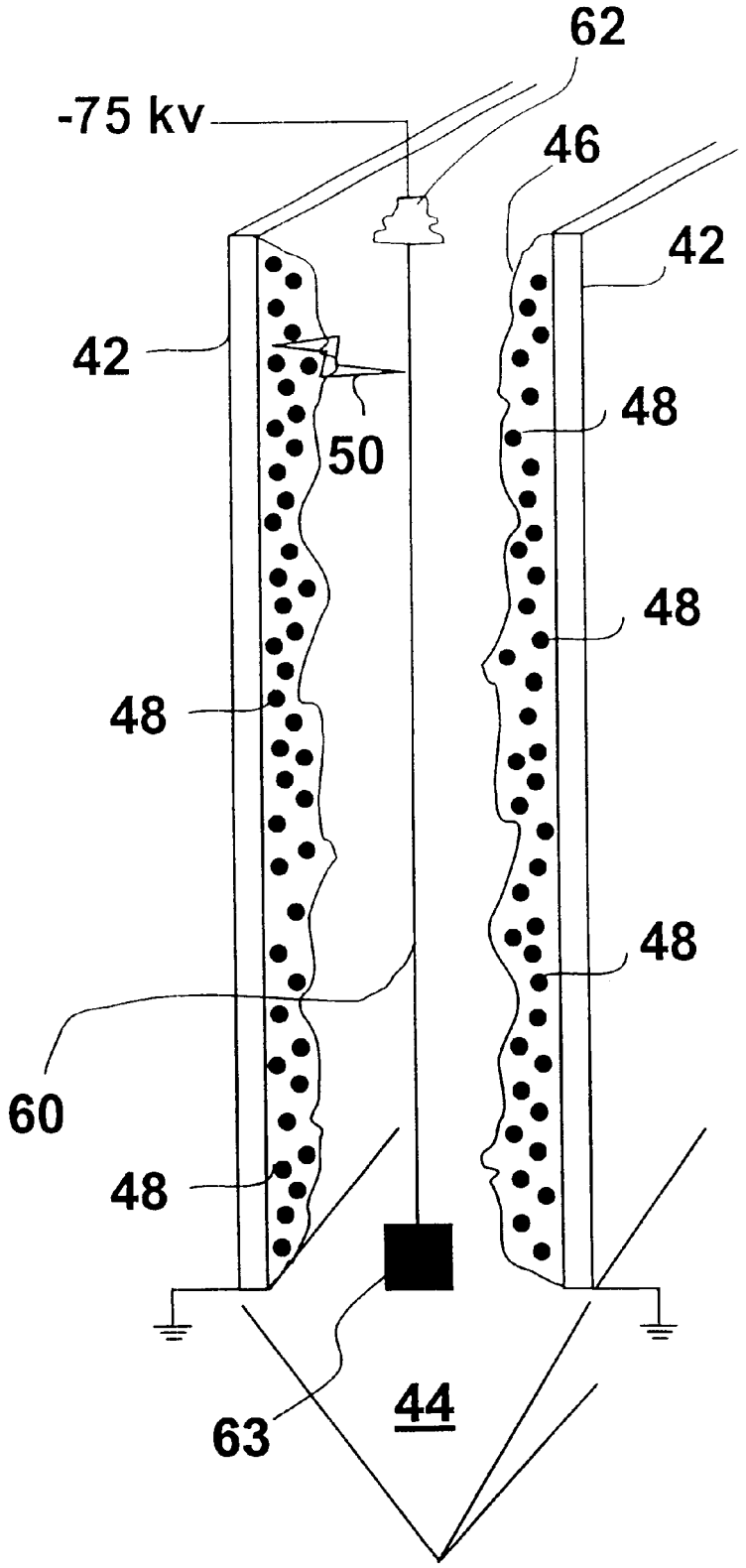
FIG. 4 is a perspective view of two plates of the electrostatic precipitator shown in FIG. 3 illustrating collection of flyash and other particulates by the plates of the electrostatic precipitator.

Flyash particles collect on the plates 42 of the ESP 16 as illustrated in FIG. 4. Two plates 42 are illustrated in FIG. 4, and they are grounded which causes them to have positive potential of +75 kV relative to the −75 kV of the emitting electrode 60. As the flue gas flows in between the plates 42, the voltage developed between the plates 42 and the emitting electrodes 60 drives the negatively charged flyash particles 46 to the plates 42 with the positive charge. At regular intervals, the plates 42 of the ESP 16 are rapped, releasing the flyash 46 therefrom which falls and collects in the respective reservoir 44. Since the plates 42 are shaken by being hit or rapped, the intervals between raps is often called the rapping frequency.

The functioning of the ESP 16 is sensitive to the condition of the flyash 46. In fact, the ESP 16 does not operate very well with flyash containing carbon inhomogeneities. As shown in FIG. 4, if carbon inhomogeneities 48 are present in the flyash 46, a build-up of the carbon 48 as it is collected with the flyash 46 may cause sparking, shown at 50, to occur between the plates 42 and the emitting electrode 60. This degrades performance of the ESP 16 and could result in damage to the emitting electrode 60.

The present inventive method is to operate the furnace 10 or boiler 12 using input data from the ESP 16. It has been found that as the gaseous by-product flows from the boiler 12 to the ESP 16, parallel flue gas flow fields are formed, with each parallel flow field associated with a different region of the combustion zone 30 and different burners 20. Each of the parallel flue gas flow fields flows through the ESP 16 in a respective flow area $\mathbf{16}_1$, $\mathbf{16}_2$, $\mathbf{16}_3$, $\mathbf{16}_4$ and $\mathbf{16}_5$ between the plates 42. Thus, by monitoring the operating parameters of the ESP 16 on a section-by-section basis, it can be determined which regions of the boiler 12 are not obtaining complete combustion, which results in collection problems. Each region is associated with one or more burners 20 as illustrated in FIG. 2. Modifications can then be made to the burners 20 burning within those regions in an effort to achieve complete combustion and optimize furnace operation, flyash collectivity and ESP performance. Various of the modifications that may be made to each of the burners 20 include modifying the fuel/air ratio, modifying the primary flow rate of the fuel/air mixture, and modifying the secondary air flow by adjusting individual burner dampers 70 associated with each burner 20.

As shown in FIG. 1, each section $\mathbf{16}_{a1}$, $\mathbf{16}_{a2}$, . . . , $\mathbf{16}_{b1}$, $\mathbf{16}_{b2}$, . . . , $\mathbf{16}_{n1}$, $\mathbf{16}_{n2}$, . . . , of the ESP 16 is connected to a computer 51 which includes a microprocessor 52. The various operating parameters associated with each of the ESP 16 sections are input into the computer 51 which creates a dynamic process model from the data which is used to optimize operation of the furnace 10. Often it is best to only monitor only one rank of sections. The ESP operating parameters which are monitored for each of the ESP 16 sections, and thus each of the parallel air flow fields, include the spark rate, the voltage recovery rate, the power usage, and the opacity of the gaseous by-product after it exits the ESP 16. The temperature of the gas at various locations in the ESP 16 may also be useful, and other parameters such as the sulfur content of the coal or the flue gas $SO_2$ may also be utilized by the computer 51 in developing the dynamic process model. Combustibles in the flyash are generally not a good control input since these analyses are usually delayed. Moreover, reducing the flyash combustibles is more of a goal then a control input. While minimum $NO_x$ emissions are also a goal, they are easily monitored and may be input to the computer 51 as a feedback input.

Since the ESP 16 is sensitive to the condition of the flyash 46 and does not operate very well with flyash 46 containing carbon inhomogeneities 48, the ESP 16 itself is the best overall measure of carbon 48 in the flyash 46. Also the individual ESP 16 sections associated with the parallel air flow fields contain the best measure of poor spatial combustion within, and emanating from, the furnace 10. Even for flyash 46 with no carbon 48, the resistivity of the flyash 46 is important. For furnace units with a cold side ESP 16, the resistivity of the flyash 46 is a function of the temperature and the $SO_3$ content. The $SO_3$ content is almost directly related to the sulfur in the fuel, and the higher the $SO_3$ content the lower the resistivity of the flyash 46. The resistivity of the flyash 46 is also lower at lower temperatures of the gaseous by-product. The lower temperatures cause more of the $SO_3$ to condense with water as sulfuric acid which is the primary reason for the lower resistivity at lower temperatures. Flyash resistivities above approximately $10^{-10}$ ohm-cm are usually regarded as detrimental to ESP 16 performance.

The conditions of the ESP 16 are important to its operation. Power sections that are out of service deprive the ESP 16 of some of its effectiveness. Broken hanger wires and other shorts will debilitate the ESP 16. Poor rapper functioning will cause problems as will excessive flyash build-up in the hoppers 44. The usual direct indications of ESP 16 performance are spark rate and power input by section. The higher the spark rate the lower the performance of the ESP 16.

Since the various operating parameters of the ESP 16 are monitored on a section-by-section basis, the computer's 51 dynamic process model can determine which particular flow area of the ESP 16 is not at optimum power and is receiving flyash 46 with high carbon 48 in it. The computer 51 creates the dynamic process model containing all of the ESP 16, as well as furnace 10 or boiler 12, operating parameters and adjusts the airflow into the boiler 12 region by region to determine which region will improve the flyash carbon (and minimize spark rate) in the offending section of the ESP 16. This allows operation of the furnace 10 with the lowest amount of excess air, and thus the lowest levels of $NO_x$ emissions.

The dynamic process model used by the computer 51 for controlling furnace operation by monitoring ESP 16 performance is an adaptive model-based predictive controller. A predictive controller setup block creates a model of all of the ESP 16 performance indicators, ie., spark rate, power output, etc., as a function of all of the measured variables and can update the dynamic model automatically as the process operates. ESP 16 performance relationships that are embedded in the dynamic model will adapt as the furnace operation changes over time. As other operational conditions change and equipment wears, the model will adapt and keep the control of the combustion operations stable and responsive. The dynamic process model can be periodically saved and thus the adaptive model-based predictive controller creates a library of process models that are associated with different coals, and furnace 10 or boiler 12 conditions. These models may be used in the analysis of furnace 10 or boiler 12 operations and aid in optimizing overall plant performance or can relate previously learned specific operating variables to the specific coal being burned.

At times the gas from the burners will not flow in the expected parallel flow fields. Flow paths may cross or intertwine, and the flue gas from a burner 20 will not arrive at the expected section of the ESP 16. The computer 51 will, when there is a problem in a specific section of the ESP 16, adjust the burners 20 which are expected to be supplying flue gas to the problem ESP 16 section. If no response to the problem is found, the computer 51 will adjust adjacent burners 20 until the problem is reduced. The computer 51 can at this time produce a new process model of the furnace 10 and of the ESP 16. This is all done very rapidly, and if crossing patterns develop as a result of reduced load, pulverizer outages, or other repeating conditions, the new process model can be saved for just such occasions.

In addition to finding and eliminating problems in the ESP 16 which can lead to better boiler 12 operation or better ESP 16 performance, the computer 51 can, when it finds no problem in a section, call for lower air flow to the burners 20 supplying flue gas to the specific section. Thus, when the computer 51 finds no problems, it can call for lower overall excess air operation and adjustment of other air controls, such as over fire air, to minimize $NO_x$ emissions.

By controlling the operation of the furnace 10 in this manner, the operation of the ESP 16 is also optimized. By optimizing the ESP 16 parameters, such as, spark rate, power input, and other ESP 16 parameters through burner 20 and furnace 10 fuel/air adjustments, the combustion and burnout of the combustibles in the flyash 46 is improved. Optimization of these ESP 16 parameters in turn optimizes furnace 10 efficiency, reduces $NO_x$ and CO emissions, and may also control or limit furnace waterwall tube corrosion and erosion, and fouling in the convective passes.

While the ESP 16 referenced in FIGS. 1–4 has been described herein as including a single-stage hanging wire, negatively charged, emitting electrode 60 with a grounded parallel plate collecting electrode 42, the present inventive method will work with any ESP. Vorious ESPs with which the method will work include, but are not limited to, ESPs with positively charged emitting electrodes, two-stage ESPs, ESPs with fixed frame emitting electrodes, and cylindrical ESPs.

While the present invention has been described with particular reference to the drawings, it should be understood that various modifications could be made without departing from the spirit and scope of the present invention.

We claim:

1. A method of controlling operation of a furnace including a boiler having a combustion zone, a plurality of burners burning a mixture of fuel and air in the combustion zone producing a gaseous by-product, and an electrostatic precipitator in fluid communication with the boiler removing particulates from the gaseous by-product, said method comprising the steps of:

monitoring operating conditions of the electrostatic precipitator on a section-by-section basis; and controlling a select at least one of the plurality of burners based upon the section-by-section monitored operating conditions.

2. The method of claim 1, wherein the operating conditions of the electrostatic precipitator monitored on a section-by-section basis are selected from the group consisting of spark rate, voltage recovery rate, power usage, and opacity of the gaseous by-product upon exit from the electrostatic precipitator.

3. The method of claim 1, wherein each of the plurality of burners includes a primary air and fuel line and a secondary duct, the primary air and fuel line supplying the mixture of fuel and a part of the air to be burned in a preselect fuel/air ratio at a preselect primary flow rate, and the secondary duct supplying the greater part of the air used in the burning, wherein the controlling step comprises modifying at least one of the preselect fuel/air ratio, the preselect primary flow rate and a secondary flow of air from the secondary duct for a select at least one of the plurality of burners based upon the section-by-section monitored operating conditions.

4. The method of claim 1, wherein the fuel comprises coal.

5. The method of claim 1, wherein the monitored sections of the electrostatic precipitator are associated with the plurality of burners on a one to one basis.

6. The method of claim 1, wherein the particulates comprise flyash.

7. The method of claim 1, wherein the controlling step comprises controlling a select at least one of the plurality of burners based upon the section-by-section monitored operating conditions to at least one of optimize furnace operation, reduce $NO_x$ emissions, reduce CO emissions, and reduce particulates present in the gaseous by-product.

8. The method of claim 1, wherein the boiler comprises a single face fired pulverized fuel boiler.

9. The method of claim 1, wherein the boiler comprises an opposed fired pulverized fuel boiler.

10. The method of claim 1, wherein the boiler comprises a tangentially fired pulverized fuel boiler.

11. The method of claim 1, wherein the boiler comprises a cyclone fired boiler.

12. A method of controlling operation of a furnace including a boiler having a combustion zone, a plurality of burners burning a mixture of fuel and air in the combustion zone producing a gaseous by-product, and an electrostatic precipitator in fluid communication with the boiler removing particulates from the gaseous by-product, said method comprising the steps of:

assigning sections of the electrostatic precipitator to the plurality of burners based on select criteria;

monitoring operating conditions of the sections of the electrostatic precipitator; and controlling a select at least one of the plurality of burners based upon the monitored operating conditions of its assigned section of the electrostatic precipitator.

13. The method of claim 12, wherein each section of the electrostatic precipitator is assigned to a different one of the plurality of burners.

14. The method of claim 12, wherein each of the plurality of burners burns its fuel/air mixture in a different region of the combustion zone, and wherein the sections of the electrostatic precipitator are assigned to each of the plurality of burners based on that region of the combustion zone in which each of the plurality of burners burn their respective fuel/air mixture.

15. The method of claim 12, wherein the monitored operating conditions of the different sections of the electrostatic precipitator are selected from the group consisting of spark rate, voltage recovery rate, power usage, and opacity of the gaseous by-product upon exit from the electrostatic precipitator.

16. The method of claim 12, wherein each of the plurality of burners includes a primary air and fuel line and a secondary air line, the primary air and fuel line supplying the mixture of fuel and air to be burned in a preselect fuel/air ratio at a preselect primary flow rate, and the secondary air line supplying a secondary flow comprising the greater part of the air required in the burning, wherein the controlling step comprises modifying at least one of the preselect fuel/air ratio, the preselect primary flow rate and the secondary flow of air for a select at least one of the plurality of burners based upon the monitored operating condition of its assigned section of the electrostatic precipitator.

17. The method of claim 12, wherein the fuel comprises coal.

18. The method of claim 12, wherein the particulates comprise flyash.

19. The method of claim 12, wherein the controlling step comprises controlling a select at least one of the plurality of burners based upon the monitored operating conditions of its assigned section of the electrostatic precipitator to at least one of optimize furnace operation, reduce $NO_x$ emissions, reduce CO emissions, and reduce particulates present in the gaseous by-product.

20. The method of claim 12, wherein the select criteria comprises parallel streams of air flowing from the boiler to the electrostatic precipitator.

21. A method of controlling operation of a furnace including a boiler having a combustion zone, a plurality of burners burning a mixture of fuel and air in the combustion zone producing a gaseous by-product, and an electrostatic precipitator in fluid communication with the boiler removing particulates from the gaseous by-product, said method comprising the steps of:

monitoring operating conditions of the electrostatic precipitator on a section-by-section basis;

developing a dynamic process model of burner operation from the section-by-section monitored operating conditions; and controlling a select at least one of the plurality of burners based upon variations in the dynamic process model.

22. The method of claim 21, wherein the operating conditions of the electrostatic precipitator monitored on a section-by-section basis are selected from the group consisting of spark rate, voltage recovery rate, power usage, and opacity of the gaseous by-product upon exit from the electrostatic precipitator.

23. The method of claim 21, wherein each of the plurality of burners includes a primary air and fuel line and a secondary air line, the primary air and fuel line supplying a mixture of fuel and air to be burned in a preselect fuel/air ratio at a preselect primary flow rate, and a secondary air line supplying a secondary flow comprising the bulk of the air required in the burning, wherein the controlling step comprises modifying at least one of the preselect fuel/air ratio, the preselect primary flow rate and the secondary flow of air for a select at least one of the plurality of burners based upon the variations in the dynamic process model.

24. The method of claim 21, further comprising the step of assigning the sections of the electrostatic precipitator to the plurality of burners based on select criteria, and wherein the controlling step comprises controlling a select at least one of the plurality of burners based upon variations in the dynamic process model caused by changes in the monitored operating condition of its assigned section of the electrostatic precipitator.

25. The method of claim 24, wherein each of the plurality of burners burns its fuel/air mixture in a different region of the combustion zone, and wherein the sections of the electrostatic precipitator are assigned to each of the plurality of burners based on that region of the combustion zone in which each of the plurality of burners burns their respective fuel/air mixture.

26. The method of claim 25, where in the burner assignments are improved by the dynamic process model.

* * * * *